US008939810B1

(12) United States Patent
Suknanan

(10) Patent No.: US 8,939,810 B1
(45) Date of Patent: Jan. 27, 2015

(54) UNITARY MODEL AIRPLANE COMPONENT KIT

(76) Inventor: Noel F. Suknanan, South Ozone Park, NY (US)

( * ) Notice: Subject to any disclaimer, the term of this patent is extended or adjusted under 35 U.S.C. 154(b) by 393 days.

(21) Appl. No.: 13/440,668

(22) Filed: Apr. 5, 2012

(51) Int. Cl.
*A63H 27/00* (2006.01)
*A63H 27/18* (2006.01)

(52) U.S. Cl.
USPC ..... 446/34; 446/93

(58) Field of Classification Search
CPC ..... A63H 27/00; A63H 27/001; A63H 27/02; A63H 17/002
USPC ..... 446/34, 57, 60, 61, 66, 88, 93, 94; 206/575
See application file for complete search history.

(56) References Cited

U.S. PATENT DOCUMENTS

| | | | | |
|---|---|---|---|---|
| 3,640,491 | A * | 2/1972 | Harrison | 244/117 R |
| 3,935,664 | A * | 2/1976 | Neuhierl | 446/34 |
| 4,203,250 | A * | 5/1980 | Garofalo | 446/61 |
| 4,209,937 | A | 7/1980 | Witte | |
| 5,035,382 | A * | 7/1991 | Lissaman et al. | 244/190 |
| 6,186,854 | B1 * | 2/2001 | Lai | 446/34 |
| 6,224,451 | B1 * | 5/2001 | Lai | 446/34 |
| 6,306,004 | B1 | 10/2001 | Farrar | |
| 6,425,794 | B1 * | 7/2002 | Levy et al. | 446/34 |
| 6,612,893 | B2 | 9/2003 | Rehkemper et al. | |
| 6,918,627 | B2 | 7/2005 | Mataja et al. | |
| D508,094 | S | 8/2005 | Khasminsky | |
| 6,986,695 | B2 * | 1/2006 | Frontera Castaner | 446/34 |
| 7,237,750 | B2 * | 7/2007 | Chiu et al. | 244/119 |
| 7,811,150 | B2 | 10/2010 | Amireh et al. | |
| 8,128,451 | B2 * | 3/2012 | Frontera Castaner et al. | 446/34 |
| 2003/0057325 | A1 * | 3/2003 | Carroll | 244/120 |
| 2005/0106987 | A1 * | 5/2005 | Frontera Castaner | 446/34 |
| 2006/0091258 | A1 * | 5/2006 | Chiu et al. | 244/119 |

FOREIGN PATENT DOCUMENTS

CN 102180257 A * 9/2011

* cited by examiner

*Primary Examiner* — Gene Kim
*Assistant Examiner* — Alyssa Hylinski

(57) ABSTRACT

A kit for quick replacement of unitary model airplane structural components contains a first wing assembly is removable from a model airplane fuselage component so a second wing assembly from the kit can be quickly installed. A first vertical stabilizer subassembly is removable from the model airplane fuselage component so a second vertical stabilizer subassembly from the kit can be quickly installed. A first horizontal stabilizer subassembly is removable from the model airplane fuselage component so a second horizontal stabilizer subassembly from the kit can be quickly installed. The kit has a kit box for portable storage of the wing assembly, vertical stabilizer subassembly, and the horizontal stabilizer subassembly. The kit does not contain the fuselage component or a fuselage padding component.

6 Claims, 6 Drawing Sheets

UNITARY MODEL AIRPLANE COMPONENT KIT

BACKGROUND OF THE INVENTION

Model airplanes, both stationary and radio controlled, have been around nearly as long as airplanes themselves. Many of today's radio controlled model airplanes are built from balsa wood, foam or other lightweight components using designs either from published plans or from a kit. For many enthusiasts, the pleasure found in the hobby of radio controlled model airplanes is equally divided between the fabrication and radio controlled flying aspects of the hobby. Fabrication of a model airplane is typically tedious, especially when contrasted to the immediate thrill experienced when flying a radio controlled model airplane. One drawback of regular flying of the model airplane is the ever-present thought of, not if the model airplane will crash, but when will it crash, leading to many tedious hours of repair and delayed future flight outings. The present invention teaches a kit for quick replacement of unitary model airplane structural components.

SUMMARY

The present invention features a kit for quick replacement of unitary model airplane structural components.

In some embodiments, the kit comprises a unitary wing assembly. In some embodiments, a first wing assembly is removable from a model airplane fuselage component. In some embodiments, a second wing assembly can be quickly installed on the fuselage component.

In some embodiments, the kit comprises a unitary tail assembly having a vertical stabilizer subassembly and a horizontal stabilizer subassembly. In some embodiments, a first vertical stabilizer subassembly is removable from the model airplane fuselage component. In some embodiments, a second vertical stabilizer subassembly can be quickly installed on the fuselage component. In some embodiments, a first horizontal stabilizer subassembly is removable from the model airplane fuselage component. In some embodiments, a second horizontal stabilizer subassembly can be quickly installed on the fuselage component.

In some embodiments, the kit comprises a kit box for portable storage of the wing assembly, vertical stabilizer subassembly, and the horizontal stabilizer subassembly. In some embodiments, the kit is free from the fuselage component.

In some embodiments, the kit facilitates a quick replacement of model airplane structural components when damaged in the field.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
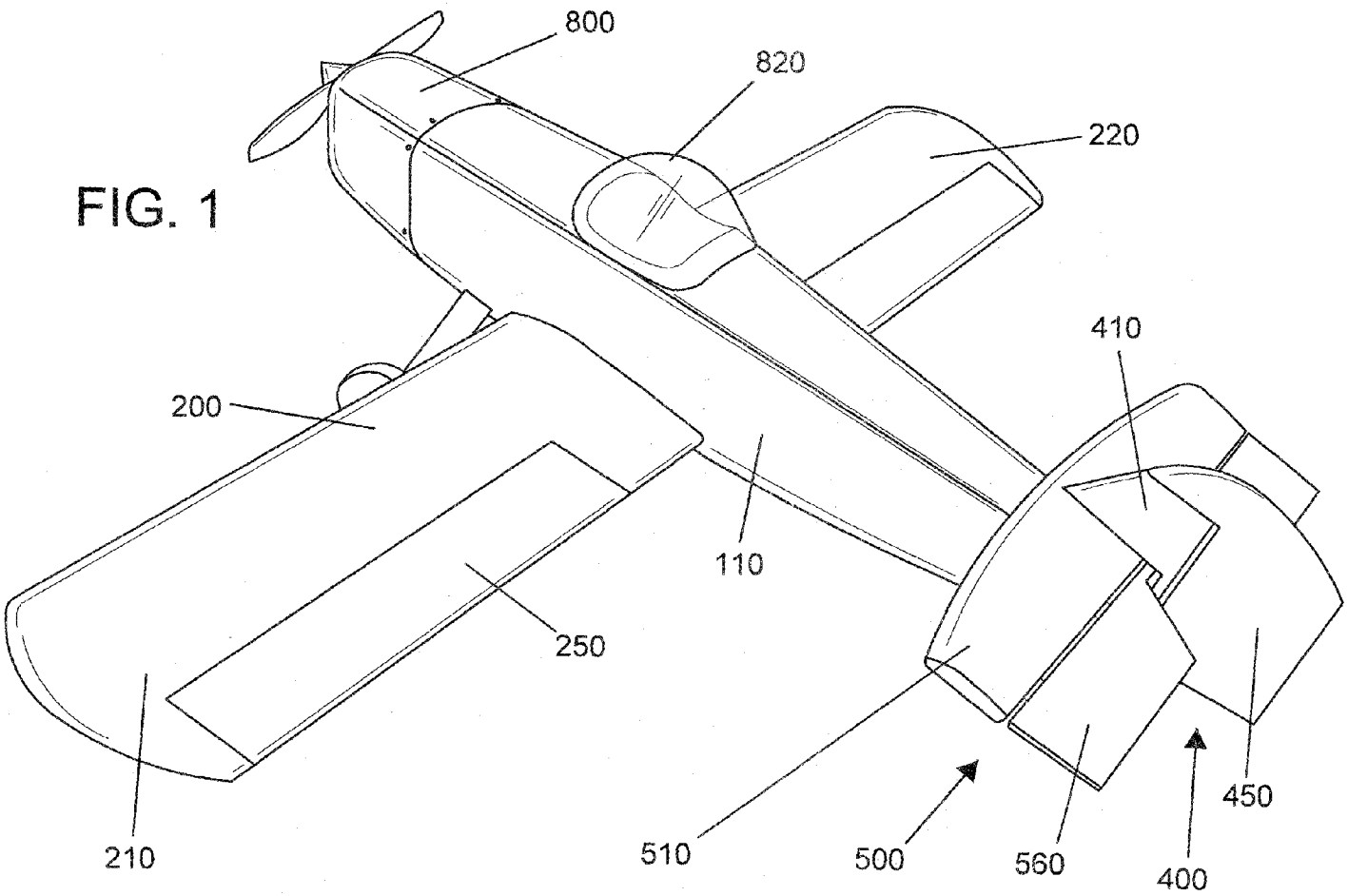
FIG. 1 is a perspective view of some components of the present invention.
Figure 2:
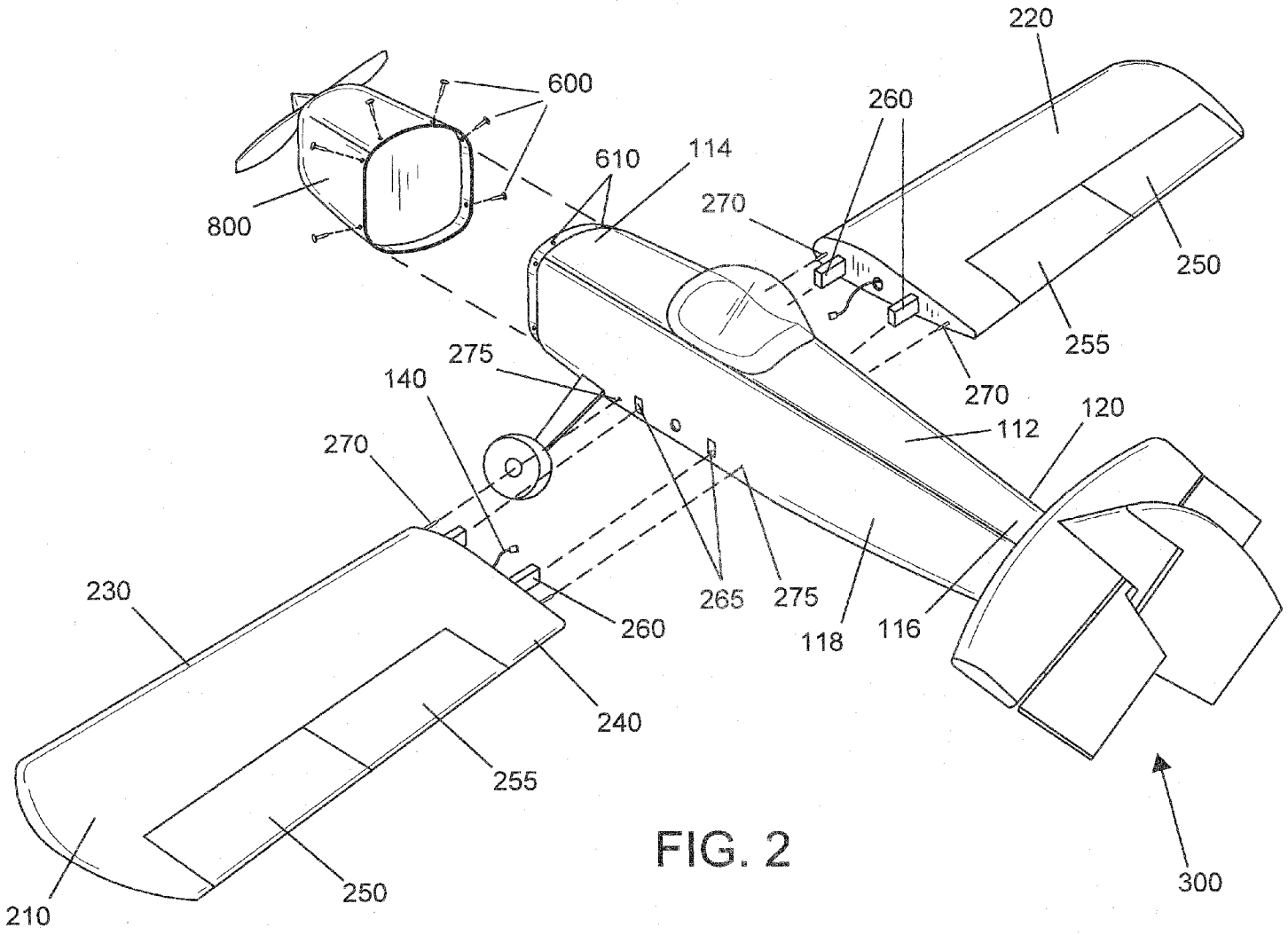
FIG. 2 is a perspective view of some components of the present invention.
Figure 3:
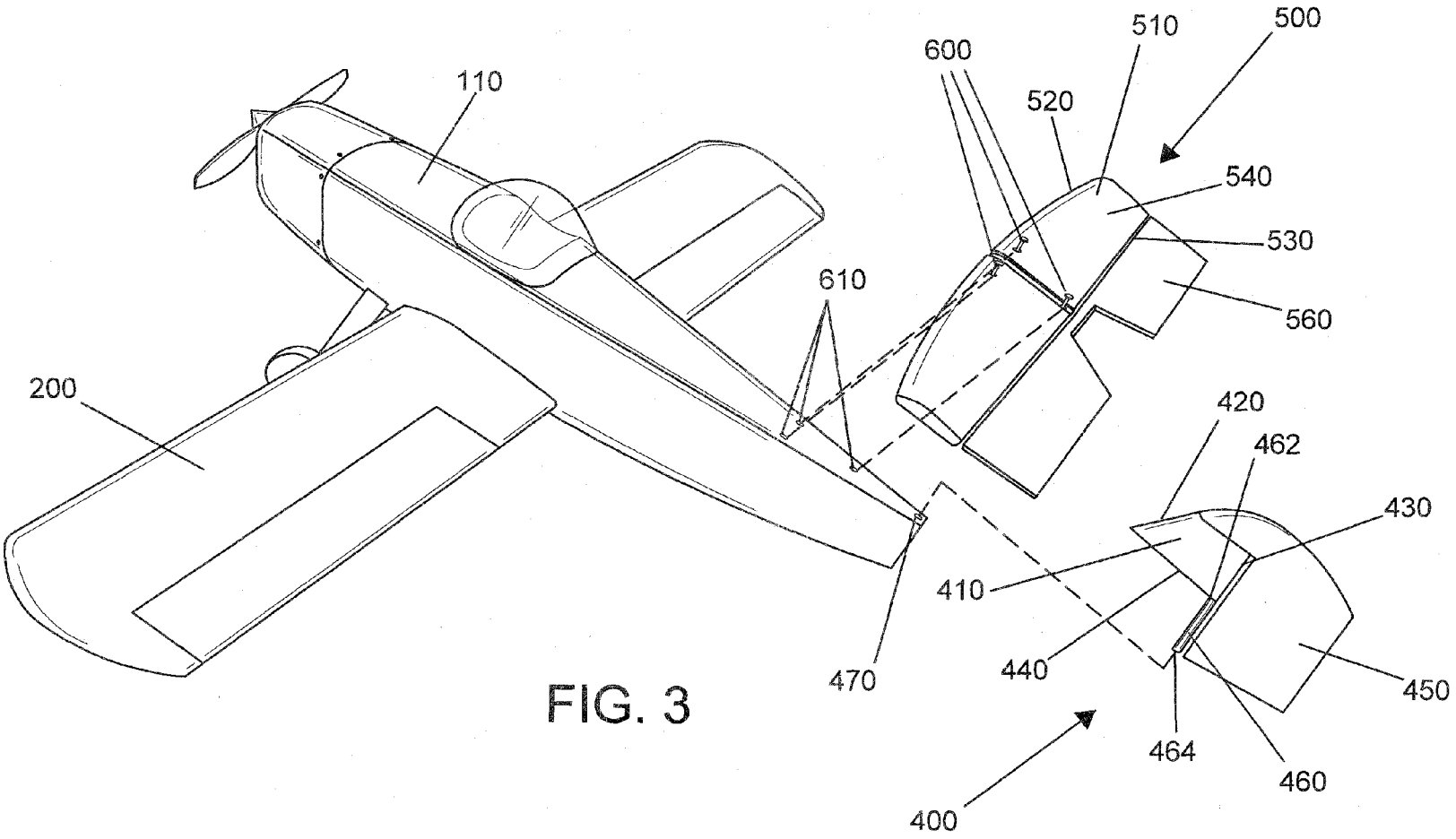
FIG. 3 is a perspective view of the tail assembly of the present invention.
Figure 4:
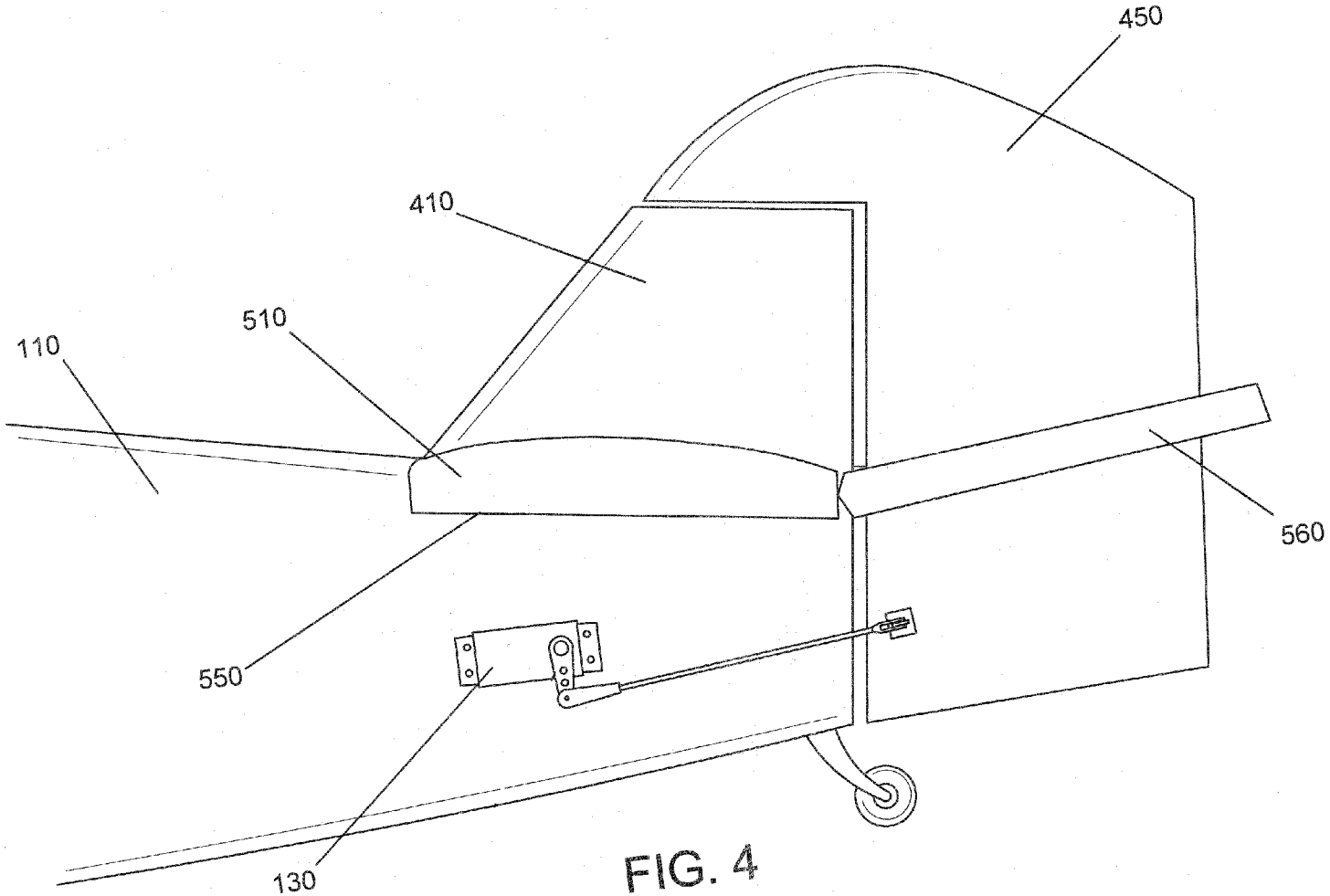
FIG. 4 is a side view of the tail assembly of the present invention.
Figure 5:
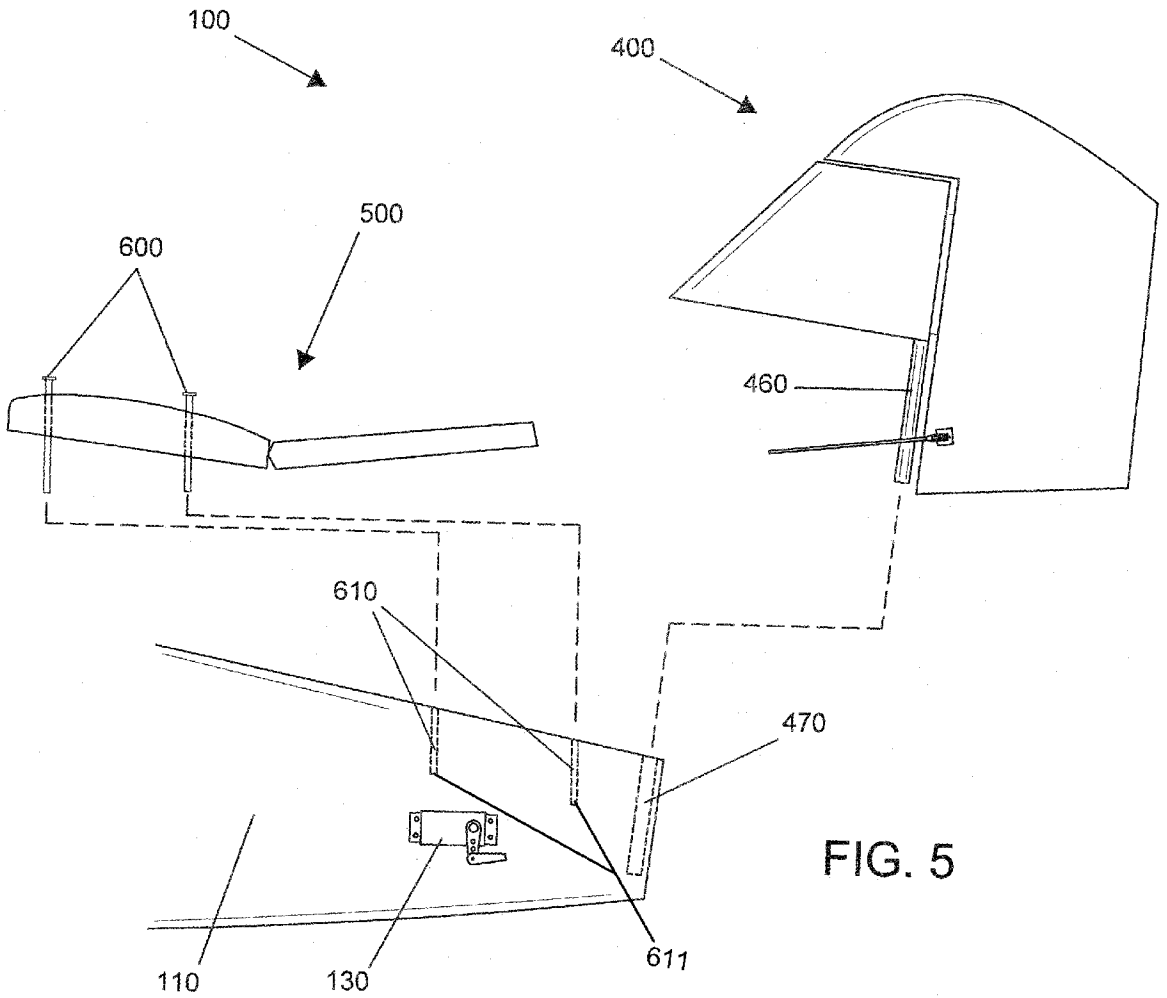
FIG. 5 is a side view of the tail assembly of the present invention.
Figure 6:
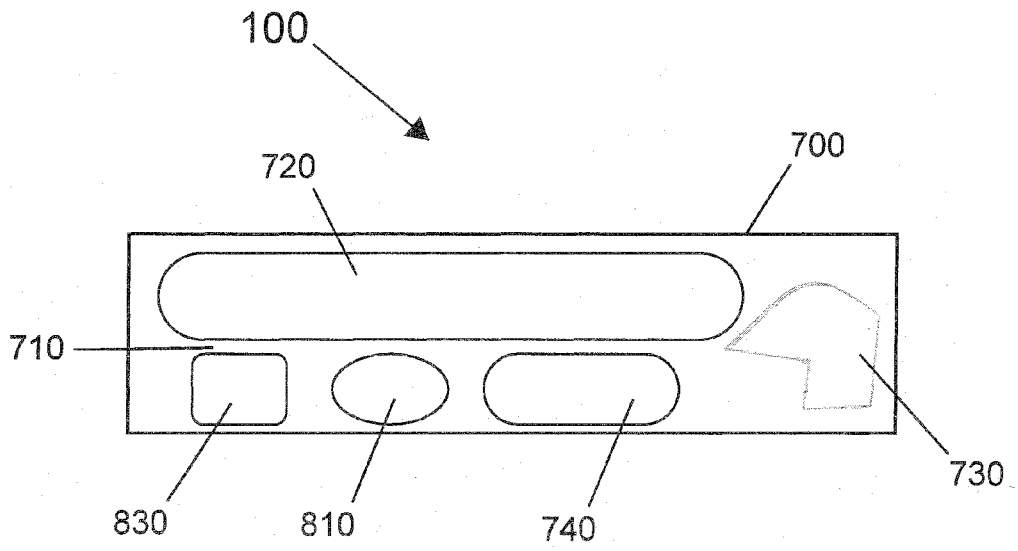
FIG. 6 is a top view of the kit box of the present invention.
Figure 7:
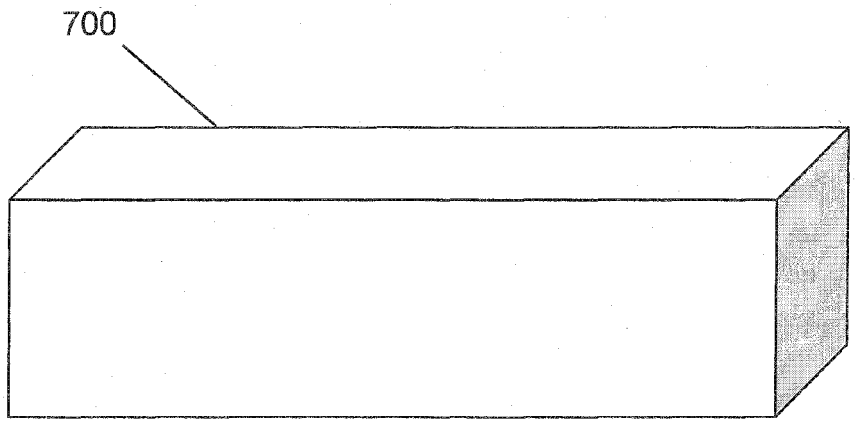
FIG. 7 is a perspective view of the kit box of the present invention.

Following is a list of elements corresponding to a particular element referred to herein:

100 Unitary model airplane structural component kit
110 Fuselage component
112 Fuselage component top surface
114 Fuselage component anterior end
116 Fuselage component posterior end
118 Fuselage component first side
120 Fuselage component second side
130 Radio control servo member
140 Radio control servo member connection
200 Wing assembly
210 First side wing subassembly
220 Second side wing subassembly
230 Wing leading edge
240 Wing trailing edge
250 Aileron
255 Flap
260 Spar projection
265 Spar receiver
270 Wing connection pin
275 Wing connection pin receiver
300 Tail assembly
400 Vertical stabilizer subassembly
410 Vertical stabilizer
420 Vertical stabilizer leading edge
430 Vertical stabilizer trailing edge
440 Vertical stabilizer bottom surface
450 Rudder
460 Stabilizer post
462 Stabilizer post first end
464 Stabilizer post second end
470 Stabilizer post receiver
500 Horizontal stabilizer subassembly
510 Horizontal stabilizer
520 Horizontal stabilizer leading edge
530 Horizontal stabilizer trailing edge
540 Horizontal stabilizer top surface
550 Horizontal stabilizer bottom surface
560 Elevator
600 Fastener
610 Internally threaded receiving unit
700 Kit box
710 Dividing component
720 Wing padding component
730 Vertical stabilizer subassembly padding component
740 Horizontal stabilizer subassembly padding component
800 Cowl
810 Cowl padding component
820 Canopy
830 Canopy padding component Referring now to FIG. 1-7, the present invention features a kit for quick replacement of unitary model airplane structural components. In some embodiments, the kit (100) comprises a unitary wing assembly (200) having a wing leading edge (230), a wing trailing edge (240), and an aileron (250) located on the wing trailing edge (240). In some embodiments, the wing assembly (200) comprises a plurality of quick connect male spar projections (260) located thereon. In some embodiments, the wing assembly (200) comprises a plurality of projecting wing connection pins (270) located thereon.

In some embodiments, a first wing assembly (200) is removable from a model airplane fuselage component (110). In some embodiments, a second wing assembly (200) can be quickly installed on the fuselage component (110) via inserting the male spar projections (260) into a plurality of female spar receivers (265) located on the fuselage component (110), and inserting the wing connection pins (270) into a plurality of wing connection pin receivers (275) located on the fuselage component (110).

In some embodiments, the kit (100) comprises a unitary tail assembly (300) having a vertical stabilizer subassembly (400) and a horizontal stabilizer subassembly (500). In some embodiments, the vertical stabilizer subassembly (400) comprises a vertical stabilizer (410) having a vertical stabilizer leading edge (420), and a vertical stabilizer trailing edge (430) with a rudder (450) located thereon. In some embodiments, the vertical stabilizer (410) further comprises a stabilizer post (460) having a stabilizer post first end (462) located on a vertical stabilizer bottom surface (440). In some embodiments, the stabilizer post second end (464) projects out and away from the vertical stabilizer bottom surface (440). In some embodiments, the stabilizer post (460) is located parallel to and in line with the vertical stabilizer trailing edge (430). In some embodiments, the stabilizer post (460) is located on the same plane as the vertical stabilizer trailing edge (430).

In some embodiments, a first vertical stabilizer subassembly (400) is removable from the model airplane fuselage component (110). In some embodiments, a second vertical stabilizer subassembly (400) can be quickly installed on the fuselage component (110) via inserting the stabilizer post second end (464) into a female stabilizer post receiver (470) located on a fuselage component top surface (112) close to a fuselage component posterior end (116).

In some embodiments, the horizontal stabilizer subassembly (500) comprises a horizontal stabilizer (510) having a horizontal stabilizer leading edge (520), a horizontal stabilizer trailing edge (530) with an elevator (560) located thereon. In some embodiments, the horizontal stabilizer (510) comprises a plurality of fasteners (600) located on a horizontal stabilizer top surface (540). In some embodiments, the fasteners (600) extend through a cross-section of the horizontal stabilizer (510) and exit through a horizontal stabilizer bottom surface (550).

In some embodiments, a first horizontal stabilizer subassembly (500) is removable from the model airplane fuselage component (110). In some embodiments, a second horizontal stabilizer subassembly (500) can be quickly installed on the fuselage component (110) via attaching the fasteners (600) to a plurality of internally threaded receiving units (610) located on the fuselage component top surface (112) close to the fuselage component posterior end (116).

In some embodiments, the kit (100) comprises a kit box (700) for portable storage of the wing assembly (200), vertical stabilizer subassembly (400), and the horizontal stabilizer subassembly (500). In some embodiments, the box comprises at least one dividing component (710) located therein. In some embodiments, the box comprises a plurality of dividing components (710) located therein. In some embodiments, the box comprises a wing padding component (720) having a hollow cavity for receiving the wing assembly (200) for storage. In some embodiments, the box comprises a vertical stabilizer subassembly padding component (730) having a hollow cavity for receiving the vertical stabilizer subassembly (400) for storage. In some embodiments, the box comprises a horizontal stabilizer subassembly padding component (740) having a hollow cavity for receiving the horizontal stabilizer subassembly (500) for storage.

In some embodiments, the kit (100) is free from the fuselage component (110). In some embodiments, the box does not comprise a fuselage padding component having a hollow cavity for receiving the fuselage component (110) for storage.

In some embodiments, the kit (100) facilitates quick replacement of model airplane structural components when damaged in the field.

In some embodiments, a cowl (800) is disposed on a fuselage component anterior end (114) via a plurality of fasteners (600) inserted through a plurality of apertures, attachably connected to a plurality of internally threaded receiving units (610).

In some embodiments, the wing assembly (200) comprises a first side wing subassembly (210), and a second side wing subassembly (220). In some embodiments, the first side wing subassembly (210) comprises a first side wing aileron (250). In some embodiments, the second side wing subassembly (220) comprises a second side wing aileron (250). In some embodiments, the first side wing subassembly (210) is for attaching to a fuselage component first side (118). In some embodiments, the second side wing subassembly (220) is for attaching to a fuselage component second side (120).

In some embodiments, the wing assembly (200) comprises a flap (255) located on the wing trailing edge (240).

In some embodiments, the kit (100) comprises a cowl (800) and a cowl padding component (810) having a hollow cavity for receiving the cowl (800) for storage. In some embodiments, the cowl (800) is for attaching to a fuselage component anterior end (114).

In some embodiments, the kit (100) comprises a canopy (820) and a canopy padding component (830) having a hollow cavity for receiving the canopy (820) for storage. In some embodiments, the canopy (820) is for attaching to the fuselage component top surface (112).

As used herein, the term "about" refers to plus or minus 10% of the referenced number. For example, an embodiment wherein the kit box is about 10 inches in width includes a kit box that is between 9 and 11 inches in width.

The disclosures of the following U.S. patents are incorporated in their entirety by reference herein: U.S. Pat. No. D 508,094; U.S. Pat. No. 7,811,150; U.S. Pat. No. 6,918,627; U.S. Pat. No. 6,612,893; U.S. Pat. No. 6,306,004; U.S. Pat. No. 4,209,937.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A kit for quick replacement of unitary model airplane structural components, wherein said kit (100) comprises:

(a) a wing assembly (200) having a wing leading edge (230), a wing trailing edge (240), and an aileron (250) disposed on the wing trailing edge (240), wherein the wing assembly (200) comprises a plurality of quick connect male spar projections (260) disposed thereon, wherein the wing assembly (200) comprises a plurality of projecting wing connection pins (270) disposed thereon;

wherein a first wing assembly (200) is removable from a model airplane fuselage component (110), wherein a second wing assembly (200) can be quickly installed on the fuselage component (110) via inserting the male spar projections (260) into a plurality of female spar receivers (265) disposed on the fuselage component (110), and inserting the wing connection pins (270) into a plurality of wing connection pin receivers (275) disposed on the fuselage component (110);

(b) a tail assembly (300) having a vertical stabilizer subassembly (400) and a horizontal stabilizer subassembly (500), wherein the vertical stabilizer subassembly (400) and the horizontal stabilizer subassembly (500) are two distinct subassemblies;

wherein the vertical stabilizer subassembly (400) comprises a vertical stabilizer (410) having a vertical stabilizer leading edge (420), and a vertical stabilizer trailing edge (430) with a rudder (450) disposed thereon, wherein the vertical stabilizer (410) further comprises a stabilizer post (460) having a stabilizer post first end (462) disposed on a vertical stabilizer bottom surface (440), wherein a stabilizer post second end (464) projects out and away from the vertical stabilizer bottom surface (440), wherein the stabilizer post (460) is in line with the vertical stabilizer trailing edge (430), wherein a first vertical stabilizer subassembly (400) is removable from the model airplane fuselage component (110), wherein a second vertical stabilizer subassembly (400) can be quickly installed on the fuselage component (110) via inserting the stabilizer post second end (464) into a female stabilizer post receiver (470) disposed on a fuselage component top surface (112) proximal to a fuselage component posterior end (116), wherein the horizontal stabilizer subassembly (500) comprises a horizontal stabilizer (510) having a horizontal stabilizer leading edge (520), a horizontal stabilizer trailing edge (530) with an elevator (560) disposed thereon, wherein the horizontal stabilizer (510) comprises a plurality of fasteners (600) disposed on a horizontal stabilizer top surface (540), wherein the fasteners (600) extend through a cross-section of the horizontal stabilizer (510) and exit through a horizontal stabilizer bottom surface (550), wherein a first horizontal stabilizer subassembly (500) is removable from the model airplane fuselage component (110), wherein a second horizontal stabilizer subassembly (500) can be quickly installed on the fuselage component (110) via attaching the fasteners (600) to a plurality of internally threaded receiving units (610) disposed on the fuselage component top surface (112) proximal to the fuselage component posterior end (116);

wherein the vertical stabilizer subassembly (400) is directly attached to the fuselage component (110) via the stabilizer post (460), wherein the horizontal stabilizer subassembly (500) is directly attached to the fuselage component (110) via the fasteners (600), and wherein attaching the vertical stabilizer subassembly (400) to the fuselage component (110) is independent of and bypasses the horizontal stabilizer subassembly (500);

wherein the internally threaded receiving units (610) are angled such that each threaded receiving unit interior end (611) is biased towards the fuselage component posterior end (116); and (c) a kit box (700) for portable storage of the wing assembly (200), vertical stabilizer subassembly (400), and the horizontal stabilizer subassembly (500), wherein the box comprises at least one dividing component (710) disposed therein, wherein the box comprises a wing padding component (720) having a hollow cavity for receiving the wing assembly (200) for storage, wherein the box comprises a vertical stabilizer subassembly padding component (730) having a hollow cavity for receiving the vertical stabilizer subassembly (400) for storage, wherein the box comprises a horizontal stabilizer subassembly padding component (740) having a hollow cavity for receiving the horizontal stabilizer subassembly (500) for storage;

wherein the kit (100) is free from the fuselage component (110), wherein the box does not comprise a fuselage padding component having a hollow cavity for receiving the fuselage component (110) for storage, wherein the kit (100) facilitates quick replacement of model airplane structural components when damaged in the field.

2. The kit (100) of claim 1, wherein the wing assembly (200) comprises a first side wing subassembly (210), and a second side wing subassembly (220), wherein the first side wing subassembly (210) comprises a first side wing aileron (250), wherein the second side wing subassembly (220) comprises a second side wing aileron (250), wherein the first side wing subassembly (210) is for attaching to a fuselage component first side (118), wherein the second side wing subassembly (220) is for attaching to a fuselage component second side (120).

3. The kit (100) of claim 1, wherein the wing assembly (200) comprises a flap (255) disposed on the wing trailing edge (240).

4. The kit (100) of claim 1, wherein the kit (100) comprises a cowl (800) and a cowl padding component (810) having a hollow cavity for receiving the cowl (800) for storage, wherein the cowl (800) is for attaching to a fuselage component anterior end (114).

5. The kit (100) of claim 1, wherein the kit (100) comprises a canopy (820) and a canopy padding component (830) having a hollow cavity for receiving the canopy (820) for storage, wherein the canopy (820) is for attaching to the fuselage component top surface (112).

6. A kit for quick replacement of unitary model airplane structural components, wherein said kit (100) consists of:

(a) a wing assembly (200) having a wing leading edge (230), a wing trailing edge (240), an aileron (250) disposed on the wing trailing edge (240), a plurality of quick connect male spar projections (260), and a plurality of projecting wing connection pins (270);

wherein a first wing assembly (200) is removable from a model airplane fuselage component (110), wherein a second wing assembly (200) can be quickly installed on the fuselage component (110) via inserting the male spar projections (260) into a plurality of female spar receivers (265) disposed on the fuselage component (110), and inserting the wing connection pins (270) into a plurality of wing connection pin receivers (275) disposed on the fuselage component (110);

(b) a tail assembly (300) having a vertical stabilizer subassembly (400) and a horizontal stabilizer subassembly (500), wherein the vertical stabilizer subassembly (400) and the horizontal stabilizer subassembly (500) are two distinct subassemblies;

wherein the vertical stabilizer subassembly (400) consists of a vertical stabilizer (410) having a vertical stabilizer leading edge (420) and a stabilizer post (460) having a stabilizer post first end (462) disposed on a vertical stabilizer bottom surface (440), and a vertical stabilizer trailing edge (430) with a rudder (450) disposed thereon, wherein a stabilizer post second end (464) projects out and away from the vertical stabilizer bottom surface (440), wherein the stabilizer post (460) is in line with the vertical stabilizer trailing edge (430), wherein a first vertical stabilizer subassembly (400) is removable from the model airplane fuselage component (110), wherein a second vertical stabilizer subassembly (400) can be quickly installed on the fuselage component (110) via inserting the stabilizer post second end (464) into a female stabilizer post receiver (470) disposed on a fuselage component top surface (112) proximal to a fuselage component posterior end (116), wherein the horizontal stabilizer subassembly (500) consists of a horizontal stabilizer (510) having a horizontal stabilizer leading edge (520) and a plurality of fasteners (600) disposed on a horizontal stabilizer top surface (540), and a horizontal stabilizer trailing edge (530) with an elevator (560) disposed thereon, wherein the fasteners (600) extend through a cross-section of the horizontal stabilizer (510) and exit through a horizontal stabilizer bottom surface (550), wherein a first horizontal stabilizer subassembly (500) is removable from the model airplane fuselage component (110), wherein a second horizontal stabilizer subassembly (500) can be quickly installed on the fuselage component (110) via attaching the fasteners (600) to a plurality of internally threaded receiving units (610) disposed on the fuselage component top surface (112) proximal to the fuselage component posterior end (116);

wherein the vertical stabilizer subassembly (400) is directly attached to the fuselage component (110) via the stabilizer post (460), wherein the horizontal stabilizer subassembly (500) is directly attached to the fuselage component (110) via the fasteners (600), and wherein attaching the vertical stabilizer subassembly (400) to the fuselage component (110) is independent of and bypasses the horizontal stabilizer subassembly (500);

wherein the internally threaded receiving units (610) are angled such that each threaded receiving unit interior end (611) is biased towards the fuselage component posterior end (116); and (c) a kit box (700) for portable storage of the wing assembly (200), vertical stabilizer subassembly (400), and the horizontal stabilizer subassembly (500), wherein the box consists of at least one dividing component (710) disposed therein, a wing padding component (720) having a hollow cavity for receiving the wing assembly (200) for storage, a vertical stabilizer subassembly padding component (730) having a hollow cavity for receiving the vertical stabilizer subassembly (400) for storage, and a horizontal stabilizer subassembly padding component (740) having a hollow cavity for receiving the horizontal stabilizer subassembly (500) for storage;

wherein the kit (100) is free from the fuselage component (110), wherein the box does not consists of a fuselage padding component having a hollow cavity for receiving the fuselage component (110) for storage, wherein the kit (100) facilitates quick replacement of model airplane structural components when damaged in the field.

* * * * *